US006313731B1

(12) United States Patent
Vance

(10) Patent No.: US 6,313,731 B1
(45) Date of Patent: Nov. 6, 2001

(54) PRESSURE SENSITIVE DIRECTION SWITCHES

(75) Inventor: Scott LaDell Vance, Cary, NC (US)

(73) Assignee: Telefonaktiebolaget L.M. Ericsson, Stockholm (SE)

( * ) Notice: Subject to any disclaimer, the term of this patent is extended or adjusted under 35 U.S.C. 154(b) by 0 days.

(21) Appl. No.: 09/553,862

(22) Filed: Apr. 20, 2000

(51) Int. Cl.[7] ..... H01C 10/46

(52) U.S. Cl. ..... 338/185; 338/128; 338/71; 200/5 A

(58) Field of Search ..... 200/5 A, 512, 200/517; 338/185, 154, 128, 118, 166, 99, 114, 71

(56) References Cited

U.S. PATENT DOCUMENTS

| | | | | |
|---|---|---|---|---|
| 5,231,386 | | 7/1993 | Brandenburg et al. . | |
| 5,429,006 | | 7/1995 | Tamori . | |
| 5,550,339 | * | 8/1996 | Haugh | 200/5 A |
| 5,744,765 | * | 4/1998 | Yamamoto | 200/6 A |
| 5,824,978 | * | 10/1998 | Karasik et al. | 200/1 B |
| 5,828,363 | | 10/1998 | Yaniger et al. . | |
| 5,912,612 | * | 6/1999 | DeVolpi | 338/95 |
| 5,926,440 | * | 7/1999 | Chien | 368/47 |
| 5,949,325 | | 9/1999 | Devolpi . | |
| 5,986,228 | * | 11/1999 | Okamoto et al. | 200/516 |

OTHER PUBLICATIONS

*High–Precision MicroJoystick Integration Guide*, State–of–the–Art Pointing Solutions for the OEM, Version 0.2, 1997 Interlink Electronics, Inc. No Month.

* cited by examiner

*Primary Examiner*—Lincoln Donovan
*Assistant Examiner*—Kyung S. Lee
(74) *Attorney, Agent, or Firm*—Myers Bigel Sibley & Sajovec

(57) ABSTRACT

Pressure sensitive direction devices are provided which may facilitate assembly and provide higher tolerance for variation in alignment of components while still providing for pressure sensitive direction detection. The devices of the present invention may be particularly advantageous when integrated into devices, such as cellular radiotelephones, to provide a user interface to facilitate user navigation through increasingly complex menu structures. In various embodiments, the present invention may detect pressure in addition to two and, preferably, at least four directions. In particular embodiments, the devices of the present invention provides a switching device having a plurality of trace grid areas located, for example, on a printed circuit board and actuated responsive to pressure applied by a user through a poly-dome layer where increase pressure results in contact with a greater number of the traces in respective grids. Alternative embodiments include trace patterns which are substantially circumferentially arranged in patterns configured to detect user input. A select switch is included in various embodiments of the present invention.

34 Claims, 12 Drawing Sheets

PRESSURE SENSITIVE DIRECTION SWITCHES

FIELD OF THE INVENTION

The present invention relates generally to input devices and more particularly to direction switches.

BACKGROUND OF THE INVENTION

As a general rule, portable devices, such as radiotelephones and computers, continue to shrink in size and to be configured in small compact packages (i.e., "pocket" sized radiotelephones). Recent radiotelephones have incorporated a variety of new features ranging from optional communication services, including Internet access, through videogames. As a result, menu structures of such devices typically become more complex. Such communication device applications, as well as devices such as laptop computers and portable games, may utilize multi-directional switches, such as 4-way switches. A select switch may be provided apart from, or integrated with, the pressure sensitive switch.

Various known approaches to pointing devices include a joystick, a mouse and a trackball. A mouse and a trackball typically use electromechanical or optical systems to convert a rotational motion of a ball to a linear motion of a cursor. Joysticks typically include an array of digital contact switches that detect when the joystick is moved in a particular direction. Various pointing devices detect both direction and pressure by sensing the magnitude and direction of a force applied to the pointing device. Examples of pressure sensitive pointing devices are described in U.S. Pat. Nos. 5,231,386 ("the '386 patent") and U.S. Pat. No. 5,828,363 ("the '363 patent").

The '386 patent is directed to a keyswitch-integrated pointing assembly in which a plurality of substantially planar force sensing elements are disposed on a planar surface adjacent a keyswitch on a keyboard. The device thus combines a keyswitch with force sensing resistor elements. A rubber dome sheet extends between the actuator element and the force sensing elements to disperse applied forces smoothly. The forcing sensing resistors are pre-loaded to bias the elements into a substantially linear operating region when no force is applied to address problems with stability associated with non-linear operating ranges of force sensing resistors.

The '363 patent is directed to another type of force-sensing pointing device utilizing force sensing resistors to detect the magnitude and position of an applied force. A connector, such as an elastomeric adhesive, maintains a force transfer member in contact with the force sensing resistors. A related product is available from Interlink Electronics of Camarillo, Calif. as described in the associated High-Precision MicroJoystick Integration Guide. This product is described as being suited to computer-cursor control and as providing both a click (select switch) function and cursor speed control responsive to the amount of an applied pressure.

SUMMARY OF THE INVENTION

The present invention provides pressure sensitive switching devices which may facilitate assembly and provide higher tolerance for variation in alignment of components while still providing for pressure sensitive direction detection. The devices of the present invention may be particularly advantageous when integrated into devices, such as cellular radiotelephones, to provide a user interface to facilitate user navigation through increasingly complex menu structures. In various embodiments, the present invention may detect pressure in addition to two and, preferably, at least four directions. In particular embodiments, the devices of the present invention may provide switching devices having a plurality of trace grid areas located, for example, on a printed circuit board and actuated responsive to pressure applied by a user through a poly-dome layer where increased pressure results in contact with a greater number of the traces in respective grids. Alternative embodiments include trace patterns which are substantially circumferentially arranged in patterns configured to detect user input. A select switch is included in various embodiments of the present invention.

In embodiments of the present invention, pressure sensitive direction devices are provided. A first member includes a plurality of contact regions, each of the contact regions including trace lines, the trace lines being formed from one of a conductive and a resistive material. A second member is positioned adjacent the first member, the second member including a plurality of deformable switch regions. The plurality of deformable switch regions are positioned adjacent the plurality of contact regions and have an inner surface on a side adjacent the first member. The deformable switch regions include a connection layer on the inner surface thereof. An actuator has contact regions positioned adjacent an outer surface of the deformable switch regions. The contact regions of the actuator deform the switch regions responsive to pressure on the actuator in the vicinity of the contact regions of the actuator to compress at least one of the deformable regions so as to bring the connection layer into contact with a number of trace lines of the contact regions of the first member, the number of trace lines being proportionate to the pressure on the actuator.

In other embodiments of the present invention, the connection layer is formed from the other of the conductive and the resistive material so that one layer is conductive and the other is resistive. Preferably, the first member includes at least three contact regions and the contact regions are positioned in spatially displaced locations on the first member. The trace lines may include a first grid of trace lines electrically coupled to a first output and a second grid of trace lines electrically coupled to a second output. The deformable switch regions may be spatially displaced domes formed in the second member. The domes may be concave when viewed with reference to the inner surface of the second member and the contact regions of the actuator may be convex when viewed with reference to the inner layer of the actuator with the convex contact regions substantially aligned with the domes. A keycap layer may be positioned adjacent an outer layer of the actuator to provide a user contact surface. The first member may be a printed circuit board and the second member may be a poly-dome layer. The resistive material may be a resistive ink and the actuator may be formed of a deformable non-conductive material.

In further embodiments of the present invention, the pressure sensitive direction device includes a select switch positioned in the pressure sensitive direction device. The select switch may include a switch contact region associated with the first member and electrically isolated from the plurality of contact regions and a conductive dome positioned adjacent the switch contact region. A select actuator may be positioned above the conductive dome and have a first position when unloaded not placing the conductive dome in contact with the switch contact region and a second position when loaded placing the conductive dome in contact with the switch contact region. The conductive dome may be a metal dome and the second member may include an aperture configured to allow the metal dome to pass through the second member. Alternatively, the second member may be a unitary member formed from a non-conductive material and including the conductive dome and the plurality of domes and the conductive dome may include a conductive material layer on the inner surface of the conductive dome. The switch contact region may be positioned between the plurality of contact regions and the conductive dome may be positioned between the plurality of domes.

In other embodiments of the present invention, the trace lines in each of the plurality of contact regions are 3 or more separate trace lines and the trace lines and the connection layer comprise a conductive material. The separate trace lines are positioned adjacent each other so as to provide a digital signal output having an increasing number of the separate trace lines being selected by contact with the connection layer responsive to increasing pressure on the actuator. An electro-luminescent panel may be formed with the poly-dome layer.

In further embodiments of the present invention, a pressure sensitive direction device is provided. A first member includes a plurality of circumferentially displaced signal contact regions and a plurality of output contact regions interspersed with the plurality of signal contact regions. A second member has a connection region positioned adjacent the signal contact regions and output contact regions of the first member. The connection region of the second member is made from a deformable material having an associated conductivity that is responsive to pressure applied to the second member. The plurality of signal contact regions includes a first group associated with a first direction and a second group associated with a second direction and a larger number of the first group are positioned in a region of the first member associated with the first direction than in other regions of the first member and a larger number of the second group are positioned in a region of the first member associated with the second direction than in other regions of the first member to provide an increased conductivity electrical path between the first group and the output contact regions responsive to pressure applied to the second member adjacent the region of the first member associated with the first direction and an increased conductivity electrical path between the second group and the output contact regions responsive to pressure applied to the second member adjacent the region of the first member associated with the second direction. The increased conductivity may be a function of the pressure applied to the second member.

In other embodiments of the present invention, the plurality of output contact regions are electrically connected. The second member may be made from a material selected from partially conductive silicon rubber or Santoprene™. The material of the second member may include conductive particles distributed in the material to provide a range of conductivity between one of the plurality of signal contact regions and an adjacent one of the plurality of output contact regions from between about 5 ohms and about 100 kilo-ohms when a portion of the second member contacts the one of the plurality of signal contact regions and the adjacent one of the plurality of output contact regions. The conductivity between the one of the plurality of signal contact regions and the adjacent one of the plurality of output contact regions is a function of the pressure applied to the second member. The conductive particles may be carbon particles. A spacer may be positioned between the first member and the second member to position the connection region offset from the plurality of signal contact regions when pressure is not applied to the second member. The second member may include a joystick or a toggle top on a face thereof away from the first member.

In other embodiments of the present invention, the plurality of signal contact regions further includes a third group associated with a third direction and a fourth group associated with a fourth direction. The first and second group correspond to a first axis and the third and fourth group correspond to a second axis substantially perpendicular to the first axis. The plurality of circumferentially displaced signal contact regions may be arranged in a substantially circular pattern wherein one of the output contact regions is positioned substantially on the first axis in the region of the first member associated with the first direction and positioned between two of the signal contact regions of the first group and one of the output contact regions is positioned substantially on the first axis in the region of the first member associated with the second direction and positioned between two of the signal contact regions of the second group. One of the output contact regions may be positioned substantially on the second axis in a region of the first member associated with the third direction and positioned between two of the signal contact regions of the third group and one of the output contact regions may be positioned substantially on the second axis in a region of the first member associated with the fourth direction and positioned between two of the signal contact regions of the fourth group.

In addition one of the signal contact regions of the first group may be positioned in the region of the first member associated with the third direction on an end thereof adjacent the region of the first member associated with the first direction and one of the signal contact regions of the first group may be positioned in the region of the first member associated with the fourth direction on an end thereof adjacent the region of the first member associated with the first direction. One of the signal contact regions of the second group may be positioned in the region of the first member associated with the third direction on an end thereof adjacent the region of the first member associated with the second direction and one of the signal contact regions of the second group may be positioned in the region of the first member associated with the fourth direction on an end thereof adjacent the region of the first member associated with the second direction. A backlighting source may be positioned between the first member and the second member.

In other embodiments of the present invention a pressure sensitive direction device is provided. A first member includes a plurality of adjacent circumferentially extending contact regions. A second member has a plurality of radially extending ridges positioned adjacent and extending substantially across widths of the plurality of contact regions, the plurality of ridges comprising a deformable material having an associated conductivity that is responsive to pressure applied to the second member. The plurality of contact regions have varying widths in the vicinity of the plurality of radially extending ridges to provide a respective conductivity between each of the plurality of contact regions responsive to pressure applied to the plurality of radially extending ridges and as a function of the relative widths of the plurality of contact regions in the vicinity of the plurality of radially extending ridges.

In further embodiments, the plurality of contact regions are each formed in a spiral pattern with the spiral patterns defining each of the plurality of contact regions beginning at offset angular positions and extending for less than 360 degrees. The second member may be made from partially conductive silicon rubber or Santoprene™. The plurality of contact regions may extend circumferentially substantially around the switch contact region. A spacer may be positioned between the first member and the second member to position the plurality of ridges offset from the plurality of contact regions when pressure is not applied to the second member.

DETAILED DESCRIPTION OF THE INVENTION

Figure 1:
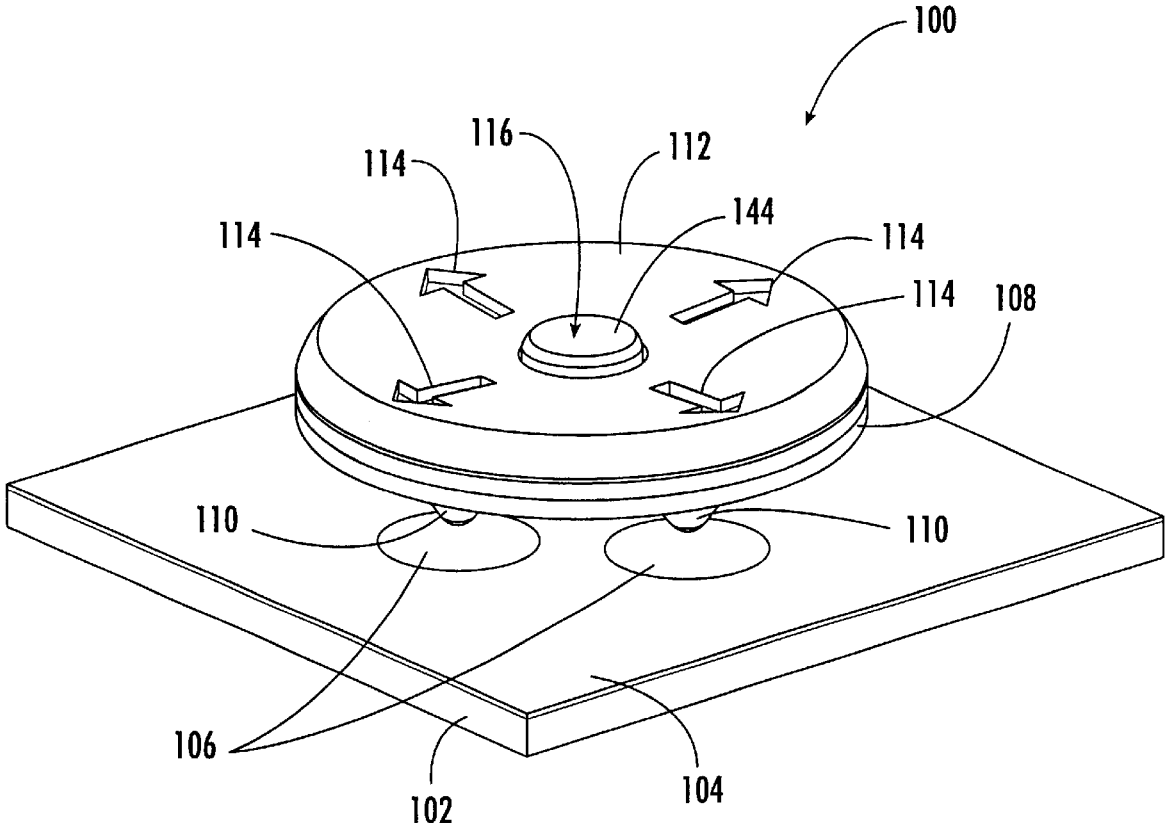
FIG. 1 is a perspective view of a pressure sensitive pointing device according to embodiments of the present invention.

The present invention now will be described more fully hereinafter with reference to the accompanying drawings, in which preferred embodiments of the invention are shown. This invention may, however, be embodied in many different forms and should not be construed as limited to the embodiments set forth herein; rather, these embodiments are provided so that this disclosure will be thorough and complete, and will fully convey the scope of the invention to those skilled in the art. Like numbers refer to like elements throughout. In the drawings, layers and regions may be exaggerated for clarity.

The present invention will now be described with reference to the embodiments illustrated in FIGS. 1 through 3. The pressure sensitive direction device 100 according to embodiments of the present invention illustrated in FIGS. 1 through 3 includes a first member 102 including a plurality of contact regions 120. Each of the contact regions includes trace lines 122, 124 formed from either a conductive or a resistive material. As shown in the illustrated embodiments of FIGS. 1 through 3, the first member 102 is provided as a printed circuit board (PCB) 102 including four contact regions 120 positioned in specially displaced locations on the PCB 102. Each of the contact regions 120 is associated with one of four directions defining an up and down (Y) axis and a left and right (X) axis orthogonal to the up and down (Y) axis. The traces 122, 124 may be formed on the PCB 102 and spaced in a grid pattern within each of the four contact regions 120.

Figure 2:
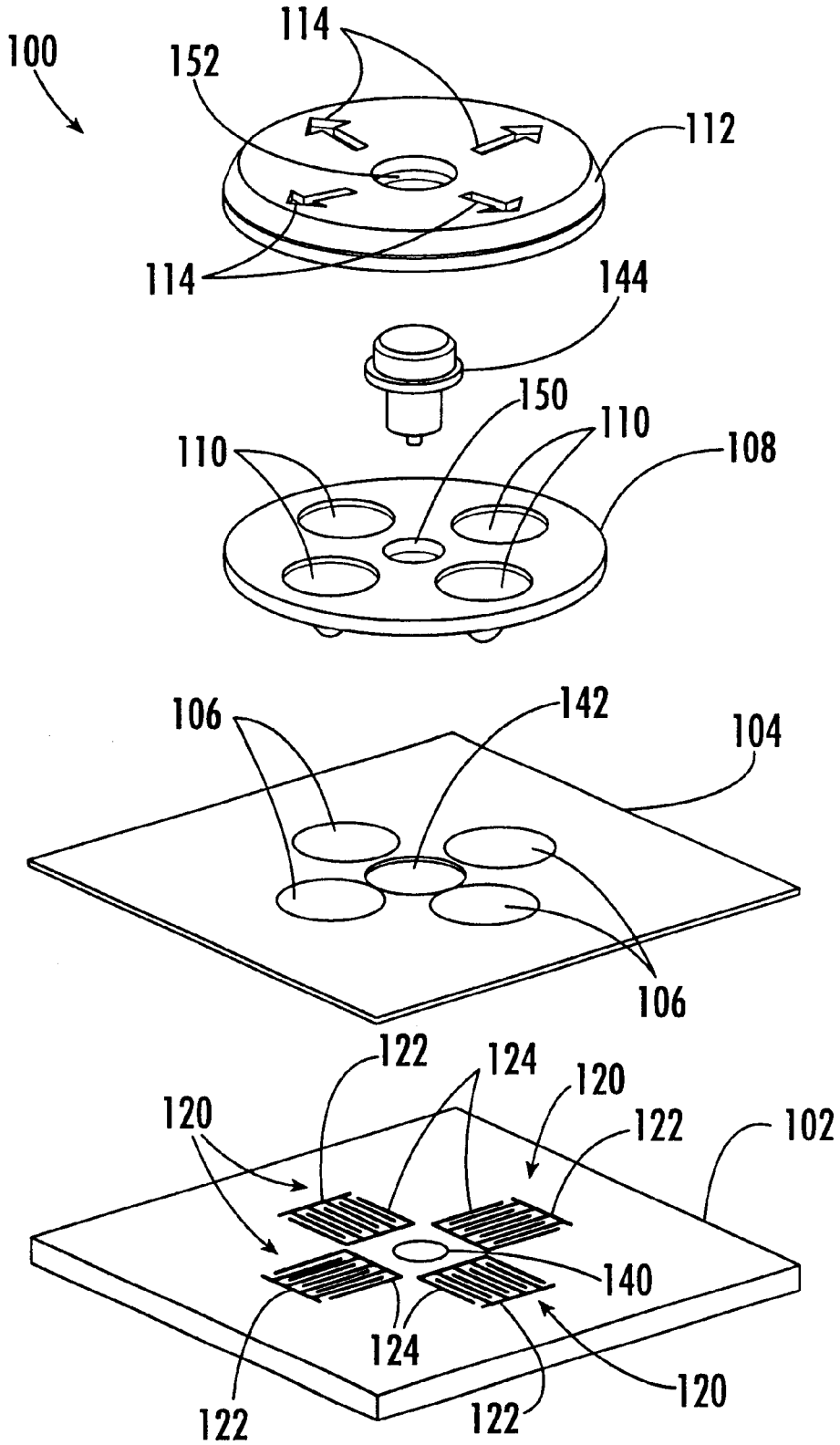
FIG. 2 is an exploded perspective view of the pressure sensitive pointing device of FIG. 1.
Figure 3:
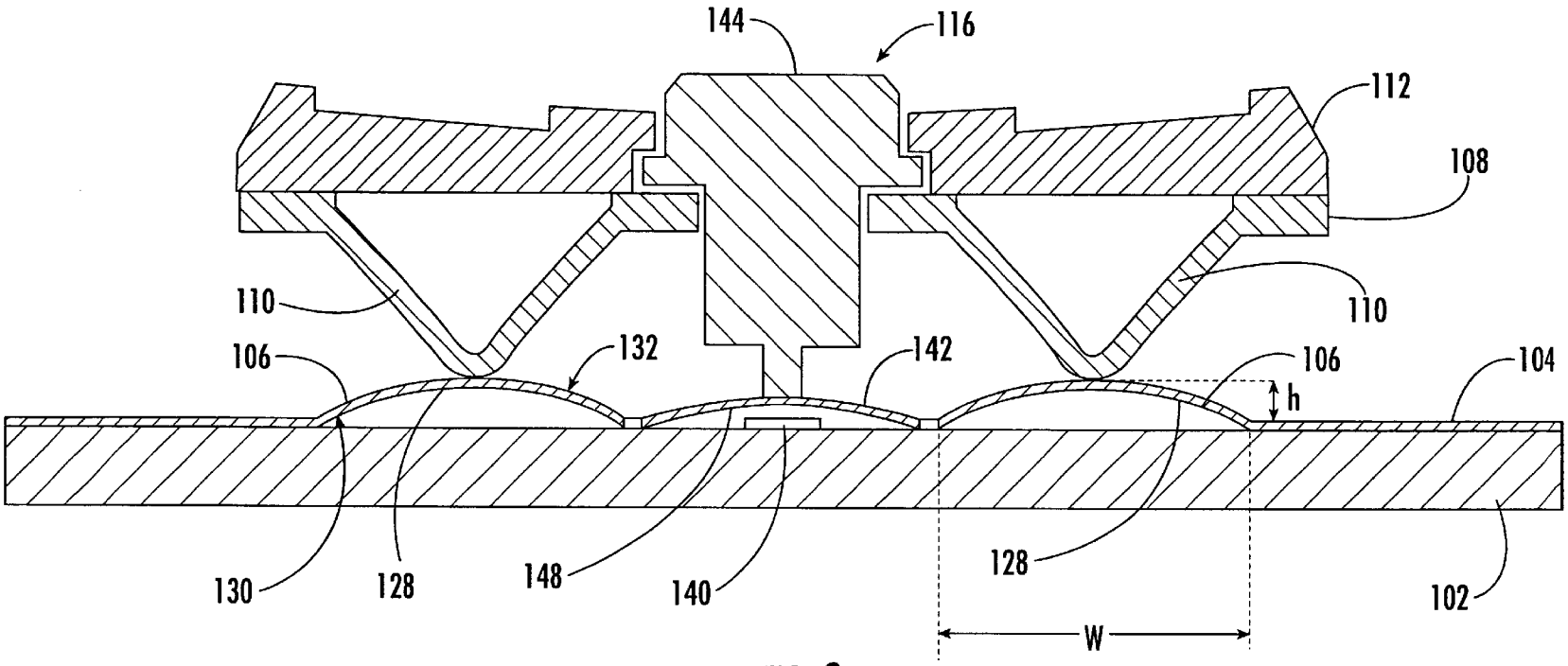
FIG. 3 is a cross-sectional view of the pressure sensitive pointing device of FIG. 1.

As shown in FIGS. 1 through 3, the trace lines 122, 124 in each contact region 120 includes a first grid of trace lines 122 coupled to a first output and a second grid trace lines 124 electrically coupled to a second output with lines of each of the first grid 122 and the second grid 124 being interspersed. As few as two contact regions 120 can be used in keeping with the present invention for a two directional pressure sensitive direction device, such as an up-down detection device. A minimum number of three contact regions 120 is preferred to obtain both direction and pressure readings and, more preferably, four contact regions 120 are used as illustrated in FIGS. 1 through 3 which may simplify reading of the signals from the pressure sensitive direction device 100 and may simplify the differentiation between X and Y axis movements and those at different angles.

The pressure sensitive direction device 100 further includes a second member 104 which is positioned adjacent the first member 102. The second member 104 includes a plurality of deformable switch regions 106. The deformable switch regions 106 are positioned adjacent the contact regions 120. More particularly, as illustrated in FIGS. 1 through 3, the second member 104 includes four deformable switch regions 106 each of which is associated with one of the four contact regions 120 and positioned adjacent thereto. The deformable switch regions 106 have an inner surface 130 on a side adjacent the PCB 102 and further include a connection layer 128 on the inner surface 130 thereof.

For the illustrated embodiments of FIGS. 1 through 3, the trace lines 122 and 124 are preferably formed of a conductive material and the connection layer 128 is formed of a resistive material. However, as will be understood by those of skill in the art, the conductive and resistive layers may be interchanged. Furthermore, while a combination of a conductive and a resistive material layers are preferred, it will be understood by those of skill in the art that resistive material layers may be used for both. Furthermore, as will be described further herein, a digital embodiments of the present invention may utilize a conductive material for both the trace lines 122, 124 and the connection layer 128.

The deformable switch regions 106 in the illustrated embodiments are spatially displaced domes formed in the second member 104. The domes 106 are concave when viewed with reference to the inner surface 130 of the second member 104. The second member 104 may be a poly-dome layer with resistive ink on the inner surface 130 in the connection layer 128. More particularly, the poly-dome layer 104, as shown, includes thin, wide domes with a relatively low profile so they may provide minimum feedback. The reference points for the width and height of the domes 106 as used herein are shown by the indication "w" and "h" respectively in FIG. 3. While the domes 106 as illustrated in FIGS. 1 through 3 are shown with low profiles, it is to be understood that they could also be provided with a higher profile so that they would provide more distinctive tactile feedback to a user. In either case, the domes 106 are preferably configured with sufficient height to keep the resistive layer 128, which is printed on the inner surface 130 on the domes 106, from contacting the traces 122, 124 on the PCB 102 when the pressure sensitive direction device 100 is not in use. This design may allow for the pressure sensitive direction device 100 to have switch functions which are normally open and have substantially no current draw when not in use.

The traces 122, 124 are preferably spaced in a grid pattern with a trace to trace spacing where the dome 106, when actuated, will connect across at least one line from each of the grids 122, 124 through the resistive layer 128 on the inner surface 130 of the domes 106. As the pressure is increased, additional connect points caused by the resistive layer 128 are provided substantially proportionally to the applied force so as to change the detected conductivity resistance and provide an output reflecting the pressure applied to the pressure sensitive direction device 100. As will be described further herein, the proportionality of the change of detected conductivity responsive to applied pressure need not be linear but may be variable with appropriate compensation to provide proper detection provided electronically.

The pressure sensitive direction device 100, as shown in the embodiments of FIGS. 1 through 3, further includes an actuator 108. The actuator 108 includes a plurality of contact regions 110 positioned adjacent an outer surface 132 of the deformable switch regions 106. The contact regions 110 of the actuator 108 are configured to deform the deformable switch regions 106 responsive to pressure on the actuator 108 in the vicinity of the respective contact regions 110 of the actuator 108 to compress one or more of the deformable switch regions 106 so as to bring the connection layer 128 into contact with a number of the trace lines 122, 124 of the contact regions 120. As shown, the contact regions 110 of the actuator 108 are convex when viewed with reference to the inner layer (i.e., the layer adjacent to the poly-dome layer 104) of the actuator 108. The convex contact regions 110 are substantially aligned with the domes 106 comprising the deformable switch regions.

As shown in the embodiments of FIGS. 1 through 3, the actuator 108 is a rubber actuator layer which comprises a sheet of rubber with inverted rubber cones providing the contact regions 110 corresponding to the position of the poly-domes 106. When the rubber is pressed, a small area of the resistive ink 128 on the inside of the poly-domes 106 is brought into contact with the traces 122, 124 on the PCB 102. As the force on the pressure sensitive detection device 100 becomes greater, the amount of area of the resistive ink 128 in contact with the trace patterns 120 on the PCB 102 generally increases. The amount of area of the resistive ink 128 which is in contact with the trace grids 120, as noted above, is preferably proportional to the force with which a user is pushing on the actuator 108.

As shown in the embodiments of FIGS. 1 through 3, the pressure sensitive direction device 100 further includes a keycap layer 112 positioned adjacent an outer surface of the actuator 108 that provides a user contact surface. For the illustrated embodiments, the keycap layer 112 may comprise a rubber or plastic layer which can be combined with the rubber actuator 108 if desired, depending upon the look and feel desired for the user from the pressure sensitive device 100. In other words, a different, for example, harder, material may be utilized for the keycap layer 112 than for the actuator 108. The keycap layer 112 may include user indicators 114, such as the up, down, left, and right arrow indications shown for the illustrated embodiments.

The keycap layer 112 and the actuator 108 may be combined with other keypad buttons in a keypad of a device such as a radiotelephone or computer. They may be positioned in a housing including sharing a front plate or other protective housing with other keys comprising the keypad. Similarly, the polydome layer 104 may be manufactured with other poly-domes utilized in the keypad in which the pressure sensitive direction device 100 is incorporated. However, preferably, the resistive ink used for the resistive layer 128 would be different from the conductive ink typically used on other known keys in keypads. As noted above, the profile of the poly-domes 106 may be varied depending on the tactile response desired. Very flat domes would be expected to provide a feel similar to a joystick while higher domes may provide more of a typical button feedback in each of the four directions (for the illustrated embodiments). Furthermore, where desired, backlighting can be provided, for example, by utilizing an electro-luminescent (EL) panel which may be formed with the polydome layer 104. Alternatively, backlighting could be provided with light emitting diodes (LEDs) in applications where backlighting is desirable. The backlighting source, where desired, may be positioned between the second member (poly-dome layer) 104 and the PCB 102.

The illustrated pressure sensitive direction device 100 further includes a select switch 116 positioned integrally with the pressure sensitive direction device 100. The select switch 116 includes a switch contact region 140 formed on the PCB 102 positioned between the plurality of contact regions 120 and electrically isolated from the contact regions 120. A conductive dome 142, such as a metal dome, is positioned adjacent the switch contact region 140. A select actuator 144 is positioned above the conductive metal dome 142. The select actuator 144 has a first position, when unloaded, not placing the conductive dome 142 in contact with the switch contact region 140 and a second position, when loaded, placing the conductive dome 142 in contact with the switch contact region 140. For the illustrated embodiments, the actuator 144 rests on an upper surface of the metal dome 142 and passes through an aperture 150 in the actuator 108. An aperture 152 is provided in the keycap layer 112 to provide a user access to the top button portion of the select actuator 144.

The metal dome 142 may be formed as a stand alone metal dome and the poly-dome layer 104 may be provided an aperture configured to allow the metal dome 142 to pass through the poly-dome layer 104 to contact the select actuator 144. Alternatively, the poly-dome layer 104 may be formed as a unitary member from a non-conductive material which includes the conductive dome 142 and the plurality of deformable switch regions 106, in which case, the conductive dome 142 further comprises a conductive material layer 148 on the inner surface of the conductive dome 142. The conductive dome 142 is positioned between the plurality of deformable switch regions 106 so as to be positioned adjacent the switch contact region 140.

Note that, while the switch contact region 140 is illustrated as being centrally located under the metal dome 142 in the illustrated figures, alternative embodiments are within the teachings of the present invention. For example, the switch contact region 140 may be provided as a conductive ring layer having an inner diameter greater than the diameter covered by the metal dome when in an uncompressed condition. In such embodiments, depression of the metal dome 142 causes an expansion of the metal dome diameter to come in contact with the switch contact region 140 which is positioned circumferentially around the metal dome 142. The use of a metal dome 142 separate from the poly-dome layer 104 may provide higher actuation forces for the select switch 116. This may help insure that the select switch 116 will be less likely to be inadvertently or accidentally depressed and activated while a user is scrolling in a particular direction utilizing the pressure sensitive direction device 100.

As noted above, the pressure sensitive detection features of the present invention may alternatively be provided utilizing a digital detection configuration wherein at least one of the trace line grids 122, 124 in one or more of the plurality of contact regions 120 comprises three or more separate trace lines and wherein the trace lines and the connection layer comprise a conductive material and the separate trace lines are positioned adjacent each other so as to provide a digital signal output having an increasing number of separate trace lines being selected by contact with the connection layer 128 responsive to increasing pressure on the actuator 108 deforming the poly-domes 106. For example, a first grouping of trace line 122 may be maintained connected as a common signal input line while the second trace line grid 124 can be separated into a plurality of individual trace lines, each detectable as having a one or zero state depending upon whether it is in contact with the trace lines 122 through the connection layer 128. As noted above, for the digital embodiments, the connection layer 128 is preferably formed of a conductive material as are the trace lines 122, 124, although a resistive material may be used. However, detection of state transitions for digital on and off states for a plurality of trace lines makes it desirable to utilize conductive materials for both the trace lines 122, 124 and the connection layer 128. A conductive ink, such as silver or carbon, would be suitable for use for such embodiments of the present invention in the connection layer 128. Increasing pressure would thus result in an increased number of the individual traces being activated.

As illustrated in embodiments of FIGS. 1 through 3, the present invention may provide for relatively inexpensive switches (direction detection devices) which may detect direction, for example, to four bits or better (i.e., in up to 16 directions). Furthermore, the switch may be provided to detect pressure, for example, to two bits or better (i.e., four speeds or more). The switch may further be provided having a design which has improved tolerance for relative positioning of components and a resulting ease of assembly compared to other known pressure sensitive direction devices. The device may further be readily integrated into existing keyboard designs for devices such as radiotelephones and computer keyboards.

Figure 12:
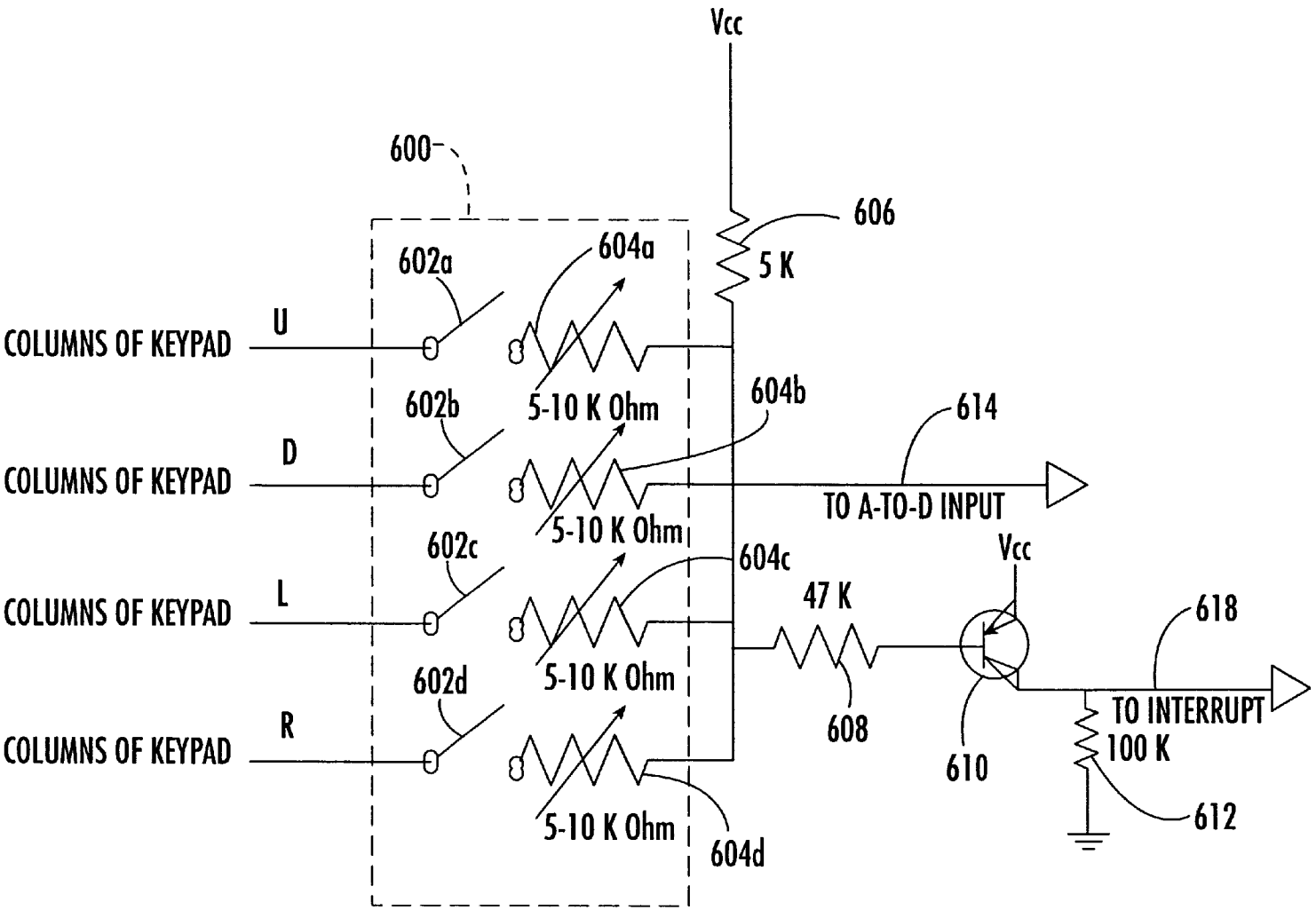
FIG. 12 is a schematic circuit diagram of an interface to a pressure sensitive pointing device suitable for use with the present invention.

Referring now to the schematic circuit diagram of FIG. 12, embodiments of electronics and signal processing suitable for use with the pressure sensitive direction devices of the present invention, including the pressure sensitive direction device 100, will now be briefly described. A pressure sensitive direction device 600 is schematically illustrated in FIG. 12 as a set of four variable resistors 604*a*, 604*b*, 604*c*, 604*d* each in series with a respective switch 602*a*, 602*b*, 602*c*, 602*d*. The switch characteristic is provided by the non-conducting characteristic of the pressure sensitive direction devices of the present invention in preferred embodiments when not in use. The variable resistances 604*a*–604*d* correspond, for example, to the four contact regions 120 illustrated in FIG. 2. Each of the respective contact regions 120, as shown in FIG. 12, is attached to a column signal of a keypad including the pressure sensitive direction device 600. The respective up (U), down (D), left (L) and right (R) selects are shown in FIG. 12.

As will be understood by those of skill in the art, a microprocessor utilizing a keypad including a pressure sensitive direction device 600 scans the keypad, it pulls the line inputs U, D, L, R low, typically, in sequence. As further shown in FIG. 12, the outputs from all the contact regions 120 (variable resistors 604*a*–604*d*) are tied to a common A to D input 614. A pull-up resistor 606 is electrically coupled to the A to D input 614. The pull-up resistor 606 is, in turn, tied to a power supply voltage $V_{cc}$. Also attached to the A to D input 614 in the illustrated embodiments of FIG. 12 is a comparator (transistor) 610 which is configured to detect when the A to D input 614 rises above a certain selected threshold voltage. The A to D input 614, in the illustrated embodiments, remains high unless one or more of the contact regions 120 is contacted, thereby activating one of the schematically illustrated switches 602*a*–602*d*. The A to D input 614 would then experience a voltage drop as a result of the current flow through the pull-up resistor 606. The A to D 614 is preferably provided to the transistor 610 so as to detect a fall of the voltage on the output 614 below a threshold reference level which may be set as ($V_{ccc}$–0.7) volts to trigger an interrupt 618 to start scanning of the keyboard.

As the keyboard scanning proceeds, the column rows U, D, L, R are, preferably, sequentially brought low in turn. When the column rows U, D, L, R corresponding to a conducting contact region 120 (shown as the variable resistances 604*a*–604*d*) is brought to a low state during scanning, the voltage level at the A to D 614 is read. The pull up resistor 606 is preferably provided as a relatively small resistance value as this may provide a maximum possible range of measurement through an analog to digital (A to D) converter. The interrupt generation circuit including the transistor 610 further includes a resistor 608, shown as a 47 kilo-ohm (kohm) resistor in the illustrated embodiment, and a pull-down resistor 612, shown as a 100 kilo-ohm resistor in the illustrated embodiment. Furthermore, the variable resistors 604*a*–604*d* are shown as having a resistance range of from between about 5 ohms and about 10 kilo-ohms in their operating range. Preferably, an operating range of between about 5 ohms and about 100 kilo-ohms and, more preferably, an operating range between about 5 ohms and about 10 kilo-ohms is provided responsive to increasing pressure as detected by the pressure sensitive direction devices of the present invention.

Figure 4:
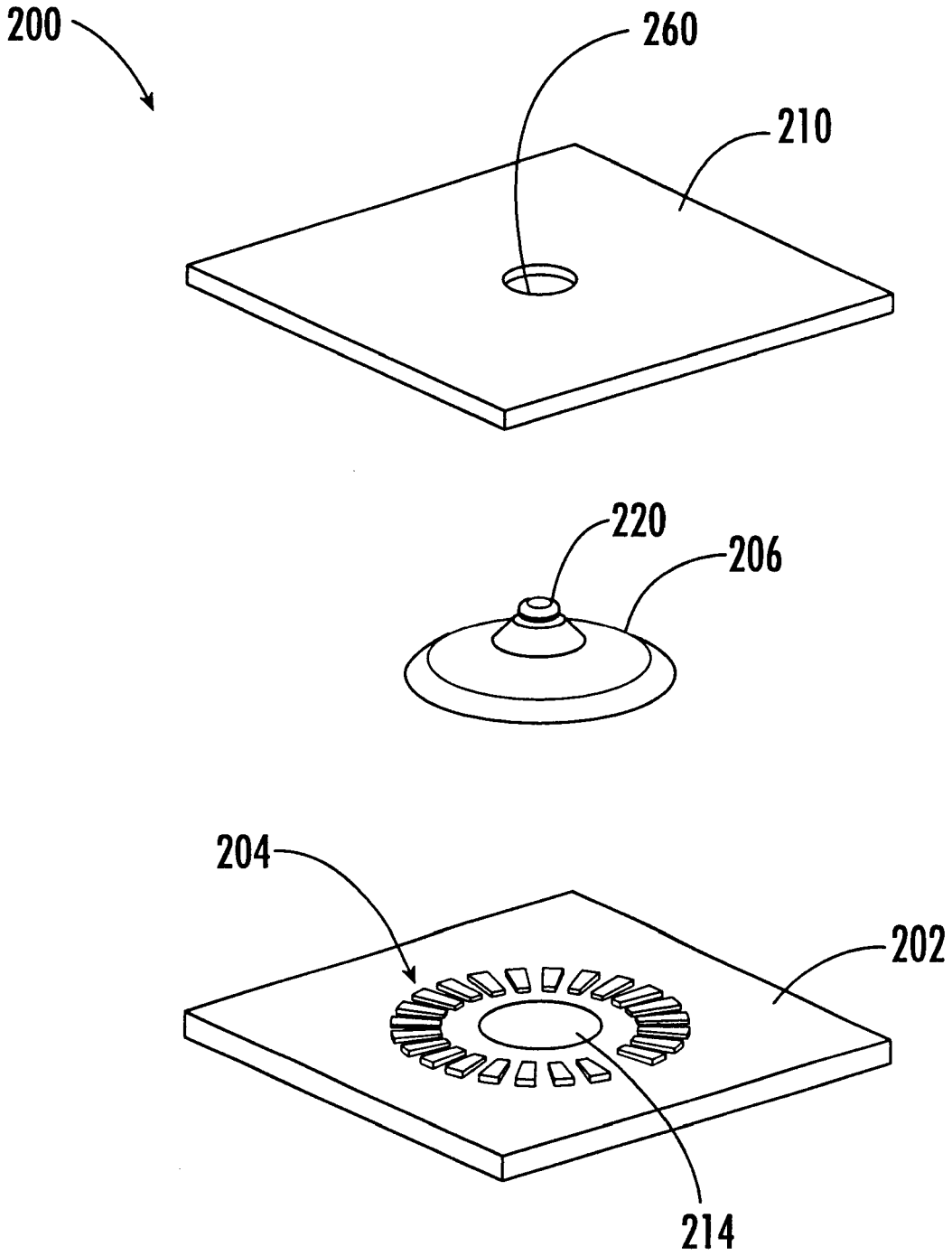
FIG. 4 is an exploded perspective view of a pressure sensitive pointing device according to further embodiments of the present invention.
Figure 5:
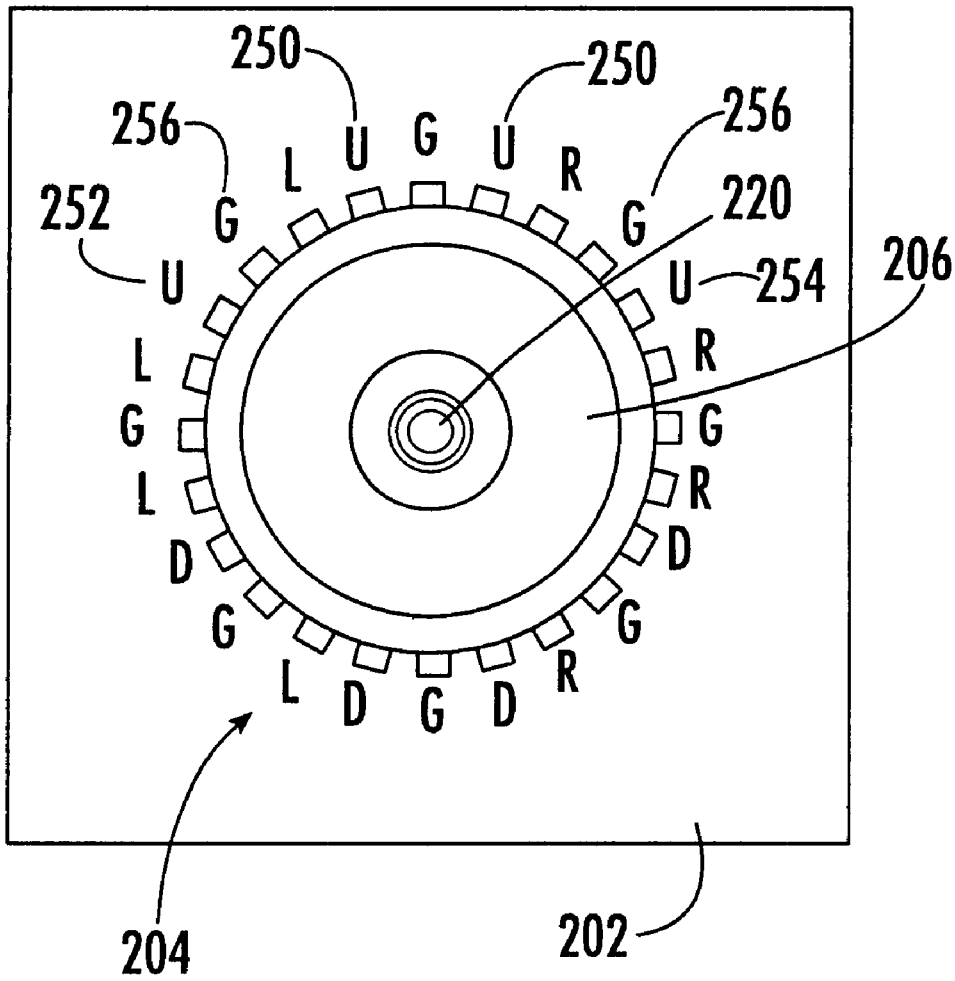
FIG. 5 is a top view of the pressure sensitive pointing device of FIG. 4 with the front housing removed.

Further embodiments of the present invention will now be described with reference to the illustrations of FIGS. 4 through 6. A pressure sensitive device 200 includes a first member 202 including a plurality of circumferentially displaced signal contact regions and a plurality of output contact regions collectively identified as 204 in FIGS. 4 and 5. As shown in FIG. 5, the output contact regions are designated G while the signal contact regions are designated as U, D, L, R which may be understood as generally referring to up, down, left and right. The first member 202, as shown, is a PCB. The output contact regions 204G may be electrically connected. Furthermore, each of the associated direction sets of the signal contact regions may be connected to provide a single output for each of the U, D, L and R contact regions.

A second member 206 is provided adjacent the PCB 202. The second member 206 includes a contact region 208 which is positioned adjacent the signal contact regions 204 U, D, L, R and the output contact regions 204G of the PCB 202. The connection region 208 of the second member 206 comprises a deformable material having an associated conductivity that is responsive to a pressure applied to the second member 206. As shown in FIGS. 4 through 6, the connection region 208 is an integral part of the second member 206. However, a composite component may be provided and the other portions of the second member 206 need not be provided formed from a material having an associated conductivity responsive to applied pressure.

The metal dome 214 is also provided on the PCB 202. A front cover 210 is shown positioned over the second member 206. As shown in FIGS. 4 and 5, the contact regions (traces) 204 are in a round grid with output regions 204G interspersed among the signal contact regions 204 U, D, L and R. In the illustrated embodiments, the grid of contact regions 204 is arranged in such a manner that the majority of the signal contact regions associated with a particular direction (or vector) are positioned in the region associated with that vector. For example, as shown in FIG. 5, the top of the figure corresponds to a first or up (U) direction and there are four up group contact regions 204U on the upper half of the round grid. Similarly, the lower direction corresponds to down (D) and there are four contact regions D of a second group associated with the down direction in the lower half of the round grid. Thus, a larger number of the U group are positioned in the upper half region of the first member associated with the up direction than in the down left or right split halves of the round grid. The same is true respectively for down left and right groups. As a result, an increased conductivity electrical path may be provided between the up group (U) and the output contact regions (G) responsive to pressure applied to the second member 206 adjacent the region of the PCB 202 associated with the up direction (shown as the top half in the orientation of FIG. 5). A similar response characteristic may be expected with respect to the down half associated with the down direction as well as the left half and right half respectively. The up 204U and down 204D contact groups correspond to a first axis associated with the up and down directions while the left 204L and right 204R groups of contact regions correspond to a second axis substantially perpendicular to the first axis, for the left and right directions respectively. However, it is to be understood that the present invention further encompasses embodiments with two or three or more directional groupings. However, the four groupings illustrated in the figures is preferred where four direction and pressure sensing is desired.

Further details of the particular embodiments of the round grid pattern are shown in FIG. 5, where the signal and output contact regions U, D, L, R, G are circumferentially displaced and arranged in a substantially circular pattern. An output contact region 204G is positioned substantially on the first axis associated with the up and with the down directions with the upper contact region 204G on the first axis in the up direction positioned between two signal contact regions 204U associated with up direction. A similar pattern is provided on the down side of the first axis as well as on the left and right ends of the second axis corresponding to the left and right directions. In addition, one of the signal contact regions 204U of the up group is positioned in the region of the PCB 202 associated with the left direction on a respective end thereof adjacent the region of the PCB 202 associated with the up direction. To aid in understanding the preceding description, the two up signal contact regions 204U adjacent the output contact region 204G on the up end of the first axis are designated by the numeral 250 in FIG. 5. The up signal contact region 204U positioned in the region of the PCB 202 associated with the left direction is designated by the numeral 252 and a further up signal contact region 204U positioned in the region of the PCB 202 associated with the right direction is designated 254. Additional output contact regions 204G are further shown designated by the numeral 256 in the upper half of the grid pattern. It will be clear to those of skill in the art as shown in FIG. 5 that the above description may also be applied to each of the left, right and down directional aspects of the illustrated embodiment. However, it is to be understood that, while it is believed the illustrated pattern shown in FIG. 5 and described above will work effectively for many applications, a variety of different patterns are possible, as will be understood by those of skill in the art, in keeping with the present invention.

The second member 206 may comprise a material selected from the group consisting of partially conductive silicon rubber and Santoprene™. The conductivity of the material of the second member 206 may be modified such that the range of resistance for each of the directions varies between about 5 and 100 kilo-ohms during usage depending upon the amount of pressure applied to the group of contact regions 204 associated with the respective direction. The second member 206 may be provided by use of a material which includes conductive particles distributed in the material to provide the desired range of conductivity (or resistance) between respective ones of the signal contact regions 204 U, D, L, R and adjacent ones of the output contact regions G. The conductivity characteristic, in use, is further configured to provide an increasing conductivity (decreasing resistance) as the pressure applied to the second member 206 is increased. The conductive particles in the material of the second member 206 may be carbon particles. The second member 206, as shown in FIG. 4, includes a joystick 220 on a face thereof away from the PCB 202. An aperture 260 is provided in the face plate 210 where the joystick 220 passes through the face plate 210 so as to be accessible to a user.

Figure 6:
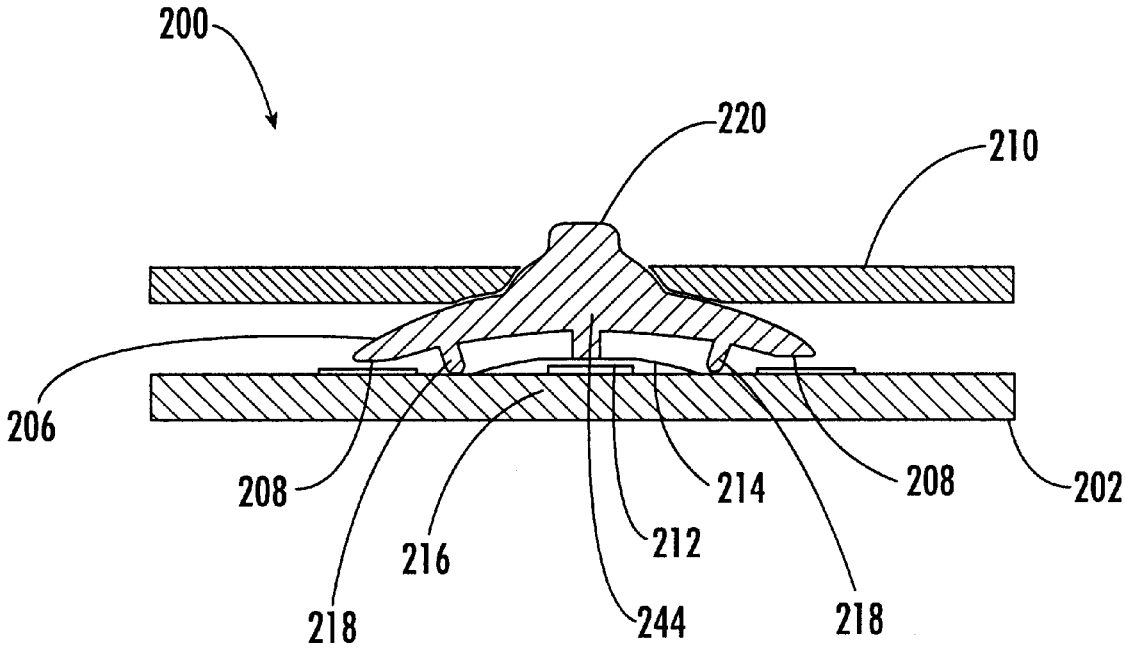
FIG. 6 is a cross-sectional view of the pressure sensitive pointing device of FIG. 4.

Referring now to FIG. 6, a select switch is shown positioned in the pressure sensitive direction device 200. The select switch includes a switch contact region 212 formed on the PCB 202 which is electrically isolated from the signal contact regions 204 U, D, L, R. A conductive dome, such as a metal dome 214, is positioned adjacent the switch contact region 212. A select actuator 216 is positioned above the metal dome 214 which has a first position, when unloaded, not placing the metal dome 214 in contact with the switch contact region 212 and a second position, when loaded placing the conductive dome 214 in contact with the switch contact region 212. As shown in FIG. 6, the select actuator 216 is provided as a region of the second member 206 positioned adjacent the metal dome 214. The switch contact region 212 is positioned between the signal contact regions 204 U, D, L, R and output contact regions 204G. As the metal dome 214 and switch contact region 212 perform in a manner substantially similar to that previously described with reference to the metal dome 142 and switch contact region 140 of FIG. 3, including the alternative embodiments described herein, the select switch will not be further described herein.

Again referring to FIG. 6, the illustrated embodiments of the pressure sensitive direction device 200 further includes a spacer 218 positioned between the first member 202 and the second member 206. The spacer 218 positions the connection region 208 offset from the contact regions 204 when pressure is not applied to the second member 206. As shown in the illustrated embodiments of FIG. 6, the spacer 218 is provided as an integrally molded region of the second member 206. However, it is to be understood that a separate, deformable member may be provided as the spacer 218.

The spacer 218 is configured to provide a pressure sensitive direction device 200 having substantially no current flow when not in use. The spacer 218 may be positioned either inside or outside the ring of contact regions 204 and further need not be a continuous ring. Providing the ring 218 inside the contact regions 204 may minimize the space requirements for the pressure sensitive direction device 200. Placing the ring 218 outside the contact regions 204 may increase the reliability of operations of the spacer 218 based upon an increased support area.

As described with reference to the embodiments of FIGS. 1 through 3, the embodiments of FIGS. 4 through 6 may be provided with a digital output by making individual ones of the contact regions 204 include 3 or more electrically isolated signal contact regions wherein the isolated contact regions are positioned adjacent each other so as to provide a digital signal output having an increasing number of the electrically isolated contact regions being selected by contact with the connection region 208 responsive to increasing pressure on the second member 206. Furthermore, backlighting can be provided by a variety of known methods, including the placement of LEDs around the metal dome 214 or directly outside of the contact area defined by the contact regions 204. The electronics described with reference to FIG. 12 may be utilized in a similar manner with the embodiments illustrated in FIGS. 4 through 6.

Figure 7:
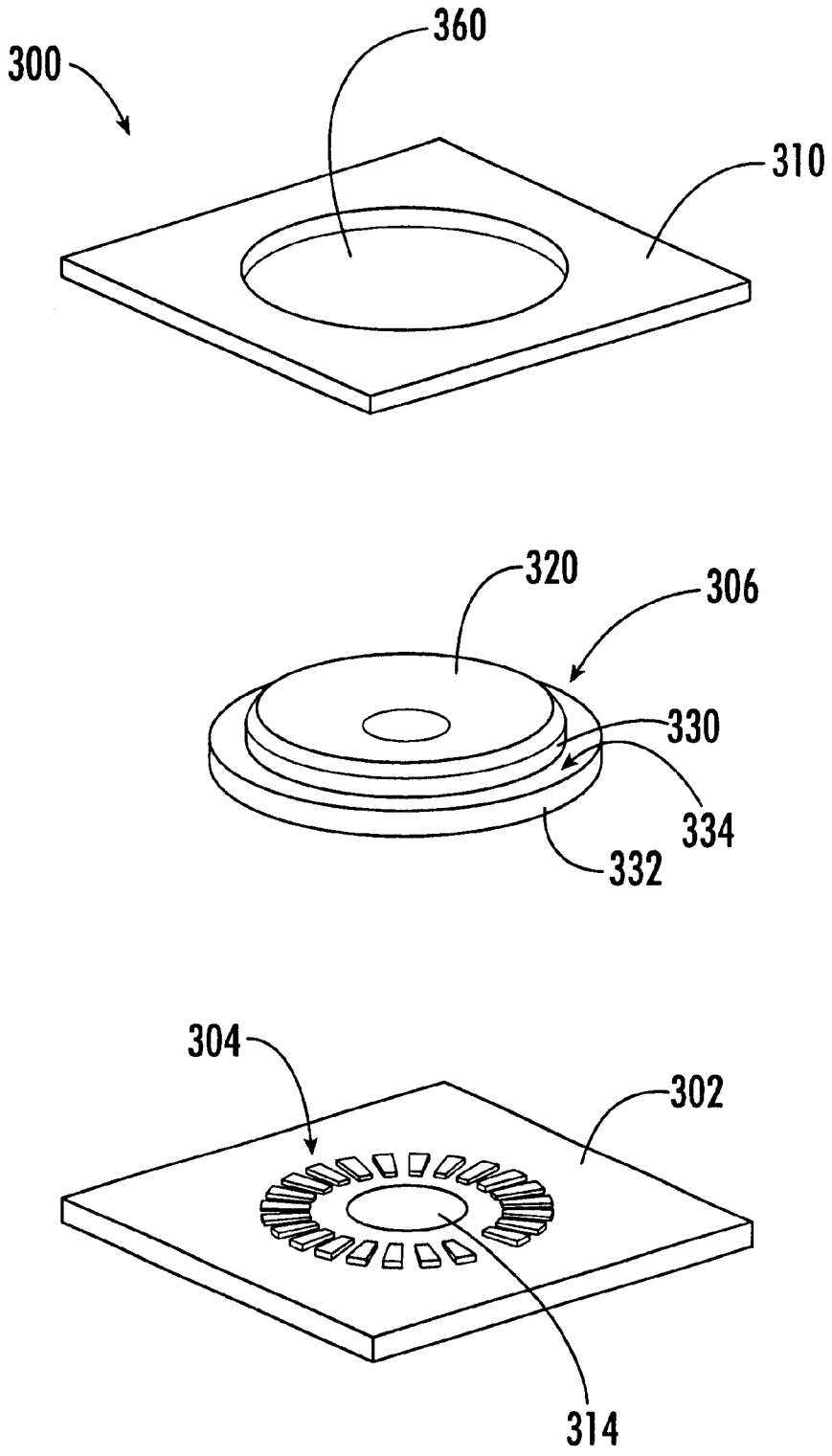
FIG. 7 is an exploded perspective view of a pressure sensitive pointing device according to further embodiments of the present invention.
Figure 8:
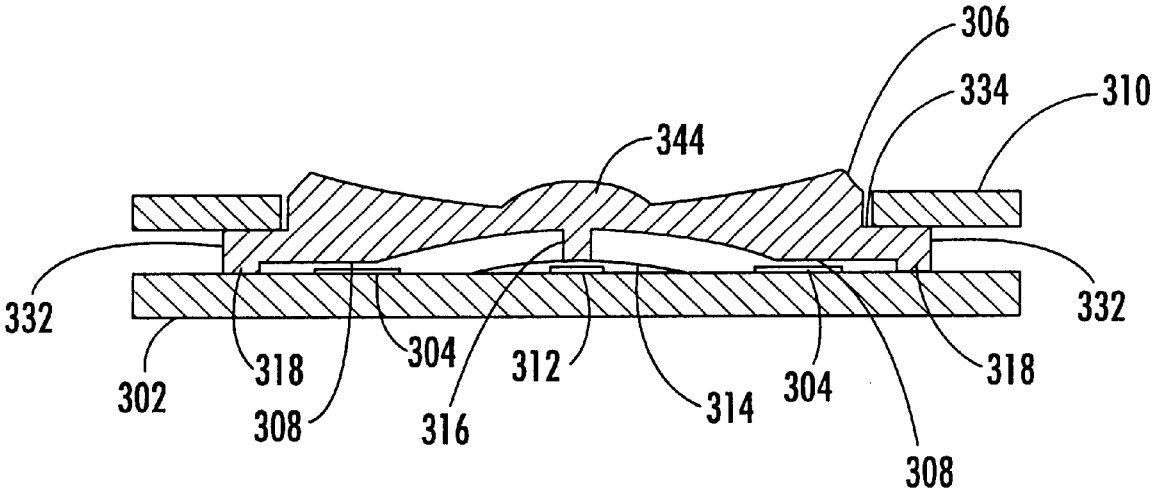
FIG. 8 is a cross-sectional view of the pressure sensitive pointing device of FIG. 7.
Figure 9:
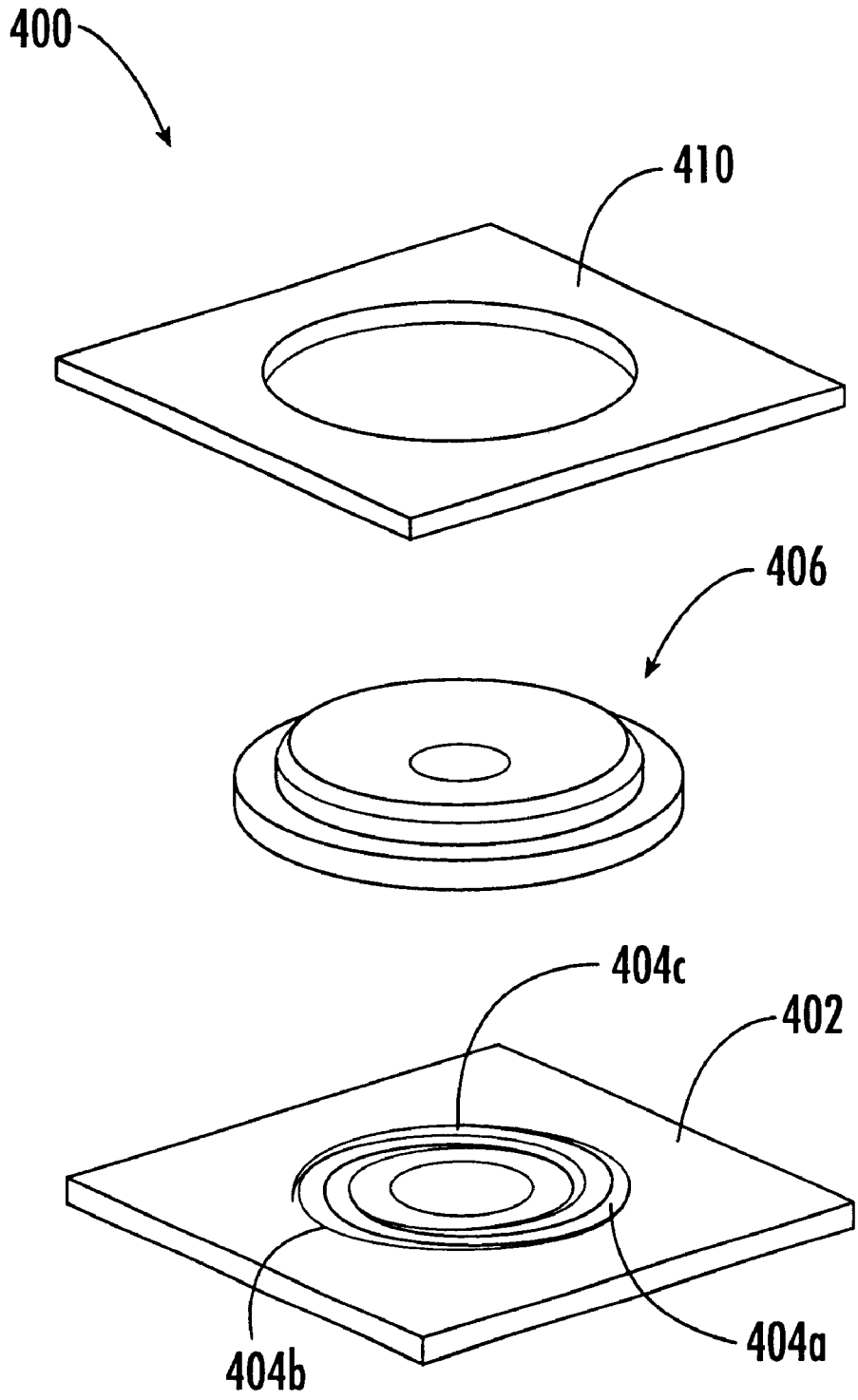
FIG. 9 is an exploded perspective view of a pressure sensitive pointing device according to further embodiments of the present invention.
Figure 10A:
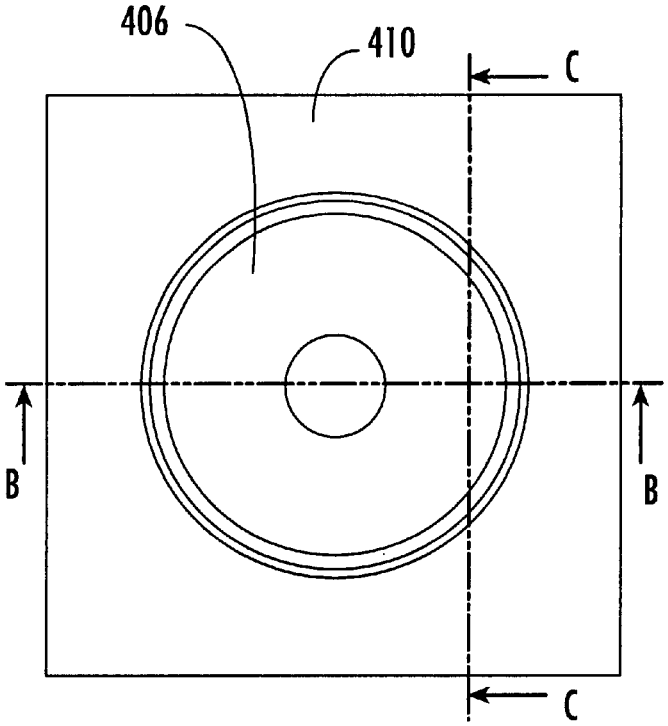
FIG. 10A is a top view of the pressure sensitive pointing device of FIG. 9.
Figure 10C:
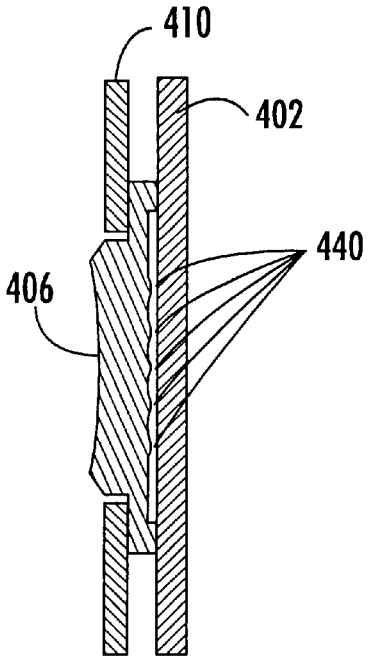
FIG. 10C is a cross-sectional view of the pressure sensitive pointing device of FIG. 10A taken along line C—C.
Figure 10B:
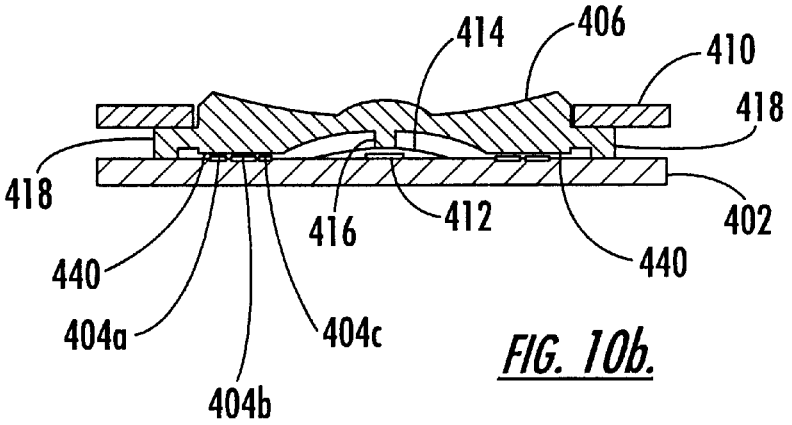
FIG. 10B is a cross-sectional view of the pressure sensitive pointing device of FIG. 10A taken along line B—B.

Further embodiments are illustrated in FIGS. 7 and 8 in which like numbered elements are provided in a manner substantially corresponding to the 200 series numbered elements discussed with reference to FIGS. 4 through 6. In the embodiments of FIGS. 7 and 8, however, a toggle top 320 is provided on the second member 306 as contrasted with the joystick 220 of the second member 206 discussed with reference to FIGS. 4 through 6. The spacer 318 is also shown as positioned outside the contact regions 304. In addition, the second member 306 includes additional features for retaining the toggle top 320 in position within the aperture 360 of the face plate 310. An extending lip portion 332 is provided having a height lower than the toggle top 320 so as to provide a substantially planer face 334 positioned below the face plate 310 while the diameters of the toggle top 320 and the aperture 360 are provided respectively so as to limit movement of the second member 306 to retain it in appropriate alignment with the contact regions 304 and the metal dome 314.

Figure 11A:
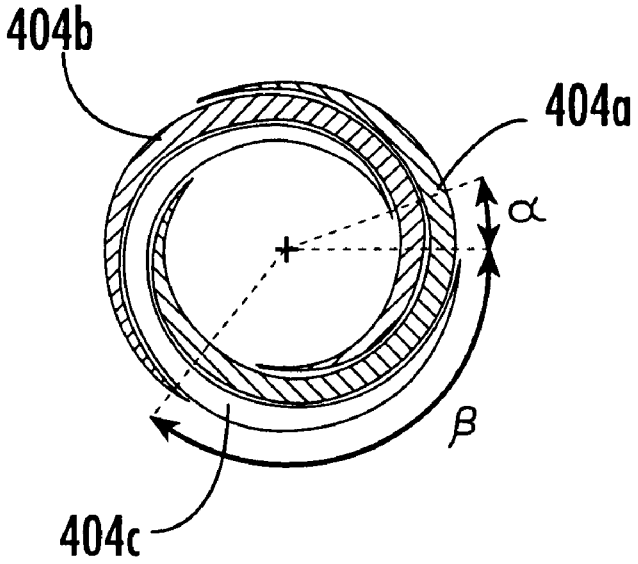
FIG. 11A is a top view of embodiments of the printed circuit board and contact regions of the pressure sensitive pointing device of FIG. 9.

Further embodiments of the present invention are illustrated in FIGS. 9, 10A, 10B, 10C, 11A and 11B. The pressure sensitive direction device 400 includes a first member 402, such as a PCB, which includes a plurality of adjacent circumferentially extending contact regions 404*a*, 404*b*, 404*c*. As shown, the contact regions 404*a*, 404*b*, 404*c* are each formed in a spiral pattern. The spiral patterns defining each of the contact regions 404*a*, 404*b*, 404*c* begin at offset angular positions and extend for less than 360 degrees. For example, as illustrated in FIG. 11A, the contact region 404*c* extends for (360-$\alpha$) degrees. Similarly, the contact region 404*c* has a start point offset by an angle $\beta$ degrees from the contact region 404*b*. A plurality of readily extending ridges 440 are provided on an inner surface of the second member 406 and positioned adjacent and extending substantially across widths of the contact regions 404*a*, 404*b*, 404*c*. The plurality of ridges 440 comprise a deformable material having an associated conductivity that is responsive to pressure applied to the second member 406 such as was previously discussed with respect to the material of the second member 206.

The contact regions 404*a*, 404*b*, 404*c* have varying widths in the vicinity of the radially extending ridges 440 to provide a respective conductivity path between each of the plurality of contact regions 404*a*, 404*b*, 404*c* responsive to a pressure applied to the radially extending ridges 440 by a user and as a function of the relative widths of the respective contact regions 404*a*, 404*b*, 404*c* in the vicinity of each of the plurality of radially extending device 440. Thus, the relative strength of an output signal on an output line from each of the three contact regions 404*a*, 404*b*, 404*c* would indicate a direction of a vector output for the pressure sensitive direction switch 400. The pressure sensitivity would be provided, for example, by summing the three signals to provide a magnitude vector for the pressure.

Figure 11B:
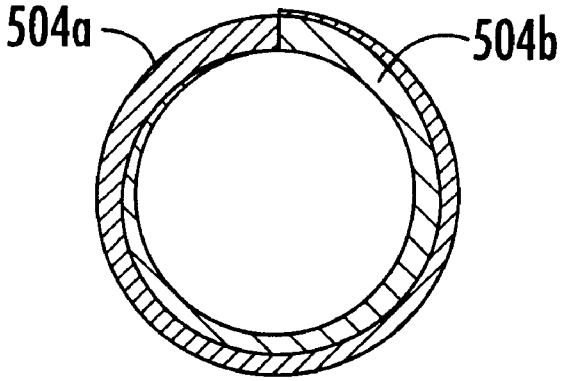
FIG. 11B is a top view of further embodiments of the printed circuit board and contact regions of the pressure sensitive pointing device of FIG. 9.

An alternative embodiment of the traces is illustrated in FIG. 11B where two contact regions 504*a*, 504*b* are provided. However, increased sensitivity may be provided by the use of additional regions such as the three illustrated in FIG. 11A or more. A select switch is also illustrated in FIG. 10 which will not be further described herein as it operates and is configured in substantially the same manner as has been described previously with respect to the select switch feature of various other embodiments. It is further to be understood that the second member 406 may be provided with the illustrated toggle top but may also be provided with a joystick type top as was described with reference to the embodiments of FIGS. 4 through 6.

The metal dome 414 may be provided with a 5 millimeter diameter. Metal domes are generally currently available commercially in diameters ranging from 4–7 millimeters. It may optionally be attached to the PCB 402 using a carrier tape and could, thus, be automatically placed in a production setting. This approach to attachment of a metal dome could similarly be applied with respect to the metal dome 142, 214 and 314 discussed with reference to the preceding embodiments.

The foregoing is illustrative of the present invention and is not to be construed as limiting thereof. Although a few exemplary embodiments of this invention have been described, those skilled in the art will readily appreciate that many modifications are possible in the exemplary embodiments without materially departing from the novel teachings and advantages of this invention. Accordingly, all such modifications are intended to be included within the scope of this invention as defined in the claims. In the claims, means-plus-function clauses are intended to cover the structures described herein as performing the recited function and not only structural equivalents but also equivalent structures. Therefore, it is to be understood that the foregoing is illustrative of the present invention and is not to be construed as limited to the specific embodiments disclosed, and that modifications to the disclosed embodiments, as well as other embodiments, are intended to be included within the scope of the appended claims. The invention is defined by the following claims, with equivalents of the claims to be included therein.

That which is claimed:

1. A pressure sensitive direction device comprising:

a first member including a plurality of contact regions, each of the contact regions including trace lines, the trace lines being formed from one of a conductive and a resistive material;

a second member positioned adjacent the first member, the second member including a plurality of deformable switch regions, the plurality of deformable switch regions being positioned adjacent the plurality of contact regions, the deformable switch regions having an inner surface on a side adjacent the first member, the deformable switch regions including a connection layer on the inner surface thereof; and an actuator having contact regions positioned adjacent an outer surface of the deformable switch regions; and wherein the contact regions of the actuator deform the switch regions responsive to pressure on the actuator in the vicinity of the contact regions of the actuator to compress at least one of the deformable regions so as to bring the connection layer into contact with a number of trace lines of the contact regions of the first member, the number of trace lines being proportionate to the pressure on the actuator.

2. The device of claim 1 wherein the connection layer comprises the other of the conductive and the resistive material.

3. The device of claim 2 wherein the first member includes at least three contact regions.

4. The device of claim 3 wherein the contact regions are positioned in spatially displaced locations on the first member.

5. The device of claim 3 wherein the trace lines further comprise a first grid of trace lines electrically coupled to a first output and a second grid of trace lines electrically coupled to a second output.

6. The device of claim 5 wherein the deformable switch regions further comprise spatially displaced domes formed in the second member.

7. The device of claim 6 wherein the domes are concave when viewed with reference to the inner surface of the second member.

8. The device of claim 7 wherein the contact regions of the actuator are convex when viewed with reference to the inner layer of the actuator and wherein the convex contact regions are substantially aligned with the domes.

9. The device of claim 8 further comprising a keycap layer positioned adjacent an outer layer of the actuator that provides a user contact surface.

10. The device of claim 6 wherein the first member comprises a printed circuit board and wherein the second member comprises a poly-dome layer and wherein the resistive material comprises a resistive ink and wherein the actuator comprises a deformable non-conductive material.

11. The device of claim 10 further comprising an electroluminescent panel (EL) formed with the poly-dome layer.

12. The device of claim 6 further comprising a select switch positioned in the pressure sensitive direction device.

13. The device of claim 12 wherein the select switch comprises:

a switch contact region associated with the first member and electrically isolated from the plurality of contact regions;

a conductive dome positioned adjacent the switch contact region; and a select actuator positioned above the conductive dome and having a first position when unloaded not placing the conductive dome in contact with the switch contact region and a second position when loaded placing the conductive dome in contact with the switch contact region.

14. The device of claim 13 wherein the conductive dome is a metal dome and wherein the second member includes an aperture configured to allow the metal dome to pass through the second member.

15. The device of claim 13 wherein the second member is a unitary member formed from a non-conductive material and including the conductive dome and the plurality of domes and wherein the conductive dome further comprises a conductive material layer on the inner surface of the conductive dome.

16. The device of claim 13 wherein the switch contact region is positioned between the plurality of contact regions and wherein the conductive dome is positioned between the plurality of domes.

17. The device of claim 1 wherein the trace lines in each of the plurality of contact regions comprise 3 or more separate trace lines and wherein the trace lines and the connection layer comprise a conductive material and wherein the separate trace lines are positioned adjacent each other so as to provide a digital signal output having an increasing number of the separate trace lines being selected by contact with the connection layer responsive to increasing pressure on the actuator.

18. A pressure sensitive direction device comprising:

a first member including a plurality of contact regions, each of the contact regions including trace lines, the trace lines being formed from one of a conductive and a resistive material, the contact regions being positioned on the first member so as to be associated with different directions;

a second member positioned adjacent the first member, the second member including a plurality of deformable switch regions, the plurality of deformable switch regions being positioned adjacent the plurality of contact regions, the deformable switch regions having an inner surface on a side adjacent the first member, the deformable switch regions including a connection layer on the inner surface thereof; and at least one actuator having contact regions positioned adjacent an outer surface of the deformable switch regions; and wherein the contact regions of the at least one actuator deform the switch regions responsive to pressure on the at least one actuator in the vicinity of the contact regions of the at least one actuator to compress at least one of the deformable regions so as to bring the connection layer into contact with a number of trace lines of the contact regions of the first member, the number of trace lines being proportionate to the pressure on the at least one actuator.

19. The device of claim 18 wherein the connection layer comprises the other of the conductive and the resistive material.

20. The device of claim 19 wherein the first member includes at least three contact regions.

21. The device of claim 20 wherein the contact regions are positioned in spatially displaced locations on the first member.

22. The device of claim 20 wherein the trace lines further comprise a first grid of trace lines electrically coupled to a first output and a second grid of trace lines electrically coupled to a second output.

23. The device of claim 22 wherein the deformable switch regions further comprise spatially displaced domes formed in the second member.

24. The device of claim 23 wherein the domes are concave when viewed with reference to the inner surface of the second member.

25. The device of claim 24 wherein the contact regions of the at least one actuator are convex when viewed with reference to the inner layer of the at least one actuator and wherein the convex contact regions are substantially aligned with the domes.

26. The device of claim 25 further comprising a keycap layer positioned adjacent an outer layer of the at least one actuator that provides a user contact surface.

27. The device of claim 23 wherein the first member comprises a printed circuit board and wherein the second member comprises a poly-dome layer and wherein the resistive material comprises a resistive ink and wherein the at least one actuator comprises a deformable non-conductive material.

28. The device of claim 23 further comprising a select switch positioned in the pressure sensitive direction device.

29. The device of claim 28 wherein the select switch comprises:

a switch contact region associated with the first member and electrically isolated from the plurality of contact regions;

a conductive dome positioned adjacent the switch contact region; and a select actuator positioned above the conductive dome and having a first position when unloaded not placing the conductive dome in contact with the switch contact region and a second position when loaded placing the conductive dome in contact with the switch contact region.

30. The device of claim 29 wherein the conductive dome is a metal dome and wherein the second member includes an aperture configured to allow the metal dome to pass through the second member.

31. The device of claim 27 further comprising an electroluminescent panel (EL) formed with the poly-dome layer.

32. The device of claim 29 wherein the second member is a unitary member formed from a non-conductive material and including the conductive dome and the plurality of domes and wherein the conductive dome further comprises a conductive material layer on the inner surface of the conductive dome.

33. The device of claim 29 wherein the switch contact region is positioned between the plurality of contact regions and wherein the conductive dome is positioned between the plurality of domes.

34. The device of claim 18 wherein the trace lines in each of the plurality of contact regions comprise 3 or more separate trace lines and wherein the trace lines and the connection layer comprise a conductive material and wherein the separate trace lines are positioned adjacent each other so as to provide a digital signal output having an increasing number of the separate trace lines being selected by contact with the connection layer responsive to increasing pressure on the at least one actuator.

* * * * *